US010748704B2

(12) United States Patent
Hirabayashi et al.

(10) Patent No.: US 10,748,704 B2
(45) Date of Patent: Aug. 18, 2020

(54) CORE COMPONENT, METHOD FOR MANUFACTURING CORE COMPONENT, AND REACTOR

(71) Applicants: AutoNetworks Technologies, Ltd., Yokkaichi, Mie (JP); Sumitomo Wiring Systems, Ltd., Yokkaichi, Mie (JP); Sumitomo Electric Industries, Ltd., Osaka-shi, Osaka (JP)

(72) Inventors: Tatsuo Hirabayashi, Mie (JP); Kouji Nishi, Mie (JP)

(73) Assignees: AutoNetworks Technologies, Ltd., Yokkaichi, Mie (JP); Sumitomo Wiring Systems, Ltd., Yokkaichi, Mie (JP); Sumitomo Electric Industries, Ltd., Osaka-Shi, Osaka (JP)

( * ) Notice: Subject to any disclaimer, the term of this patent is extended or adjusted under 35 U.S.C. 154(b) by 245 days.

(21) Appl. No.: 15/540,083

(22) PCT Filed: Jan. 8, 2016

(86) PCT No.: PCT/JP2016/050544
§ 371 (c)(1),
(2) Date: Jun. 27, 2017

(87) PCT Pub. No.: WO2016/114236
PCT Pub. Date: Jul. 21, 2016

(65) Prior Publication Data

US 2017/0352478 A1 Dec. 7, 2017

(30) Foreign Application Priority Data

Jan. 13, 2015 (JP) ..... 2015-004512

(51) Int. Cl.

| | |
|---|---|
| ***H01F 41/02*** | (2006.01) |
| ***H01F 27/22*** | (2006.01) |
| ***H01F 27/255*** | (2006.01) |
| ***H01F 37/00*** | (2006.01) |
| ***H01F 41/00*** | (2006.01) |
| ***H01F 27/26*** | (2006.01) |
| *H01F 27/245* | (2006.01) |

(52) U.S. Cl.
CPC ..... *H01F 41/0246* (2013.01); *H01F 27/255* (2013.01); *H01F 27/266* (2013.01);
(Continued)

(58) Field of Classification Search
None
See application file for complete search history.

(56) References Cited

U.S. PATENT DOCUMENTS

2007/0252771 A1* 11/2007 Maezawa ..... G06K 19/07771 343/841
2009/0121175 A1* 5/2009 Maeda ..... B22F 1/0062 252/62.51 R (Continued)

FOREIGN PATENT DOCUMENTS

JP 2010267932 A 11/2010
JP 2012044156 A 3/2012

(Continued)

OTHER PUBLICATIONS

Search Report for Int'l. Appln. No. PCT/JP2016/050544, dated Mar. 29, 2016.

*Primary Examiner* — Kevin M Bernatz
(74) *Attorney, Agent, or Firm* — Honigman LLP

(57) ABSTRACT

Provided is a core component having a powder compact and a resin-molded portion joined to each other. In a core component including a powder compact obtained by compression molding a raw material powder containing a soft magnetic powder and a resin-molded portion formed on the surface of the powder compact, and constituting a part of a magnetic core disposed inside and outside a coil included in a reactor, an intermediate layer formed of a silane coupling agent is provided between the powder compact and the resin-molded portion. The powder compact and the resin-molded portion can be bound to each other via the interme- (Continued)

diate layer formed of the silane coupling agent. The silane coupling agent not only binds chemically to the surface of the powder compact but also binds chemically to the resin-molded portion, and therefore, the joining the powder compact and the resin-molded portion via the intermediate layer.

4 Claims, 4 Drawing Sheets

(52) U.S. Cl.
CPC ..... *H01F 37/00* (2013.01); *H01F 41/005* (2013.01); *H01F 27/22* (2013.01); *H01F 27/245* (2013.01); *H01F 27/26* (2013.01)

(56) References Cited

U.S. PATENT DOCUMENTS

2009/0267855 A1* 10/2009 Maruko ..... B22F 9/082
343/788
2013/0088317 A1 4/2013 Tawara et al.
2013/0147081 A1 6/2013 Hwang et al.
2014/0333401 A1* 11/2014 Esaki ..... H01F 1/26
336/83
2015/0043262 A1 2/2015 Ito et al.
2015/0248963 A1* 9/2015 Inaba ..... H01F 1/26
363/131
2016/0083626 A1* 3/2016 Ebe ..... H01F 1/37
324/207.17
2016/0247623 A1* 8/2016 Marusawa ..... H01F 27/255
2016/0268026 A1* 9/2016 Matsutomi ..... H01F 1/26
2017/0162307 A1* 6/2017 Ishida ..... H01F 1/26

FOREIGN PATENT DOCUMENTS

JP 2012119454 A 6/2012
JP 2013084767 A 5/2013
JP 2013175566 A 9/2013
JP 2014072367 A 4/2014

* cited by examiner

CORE COMPONENT, METHOD FOR MANUFACTURING CORE COMPONENT, AND REACTOR

CROSS-REFERENCE TO RELATED APPLICATIONS

This application is the U.S. national stage of PCT/JP2016/050544 filed Jan. 8, 2016, which claims priority of Japanese Patent Application No. JP 2015-004512 filed Jan. 13, 2015.

TECHNICAL FIELD

The present invention relates to a core component that is used in a reactor used for a constituent component or the like of an in-vehicle DC-DC converter or a power conversion device installed in an electric vehicle such as a hybrid automobile, a method for manufacturing the core component, and a reactor using the core component.

BACKGROUND

Magnetic components, such as reactors and motors, are used in various fields. As such a magnetic component, for example, JP 2012-119454A discloses a reactor used for a converter of a hybrid automobile.

JP 2012-119454A discloses a reactor used for a converter installed in a vehicle such as a hybrid automobile, the reactor including a coil that is formed by helically winding a wire and a magnetic core that is formed into a ring shape by combining together a plurality of powder compacts (core pieces for the reactor) obtained by compression molding a raw material powder containing a soft magnetic powder. Also, J P 2012-119454A discloses a core component in which powder compacts are individually covered with respective insulating coating layers (resin-molded portions), a core component in which a plurality of powder compacts are collectively covered with a resin-molded portion, and the like.

There is a demand for a core component having excellent joinability between a powder compact and a resin-molded portion.

A coil included in a magnetic component such as a reactor generates heat through Joule heating when energized and does not generate heat when not energized. In particular, when the energizing current value is large as in the case of a reactor or the like used in an in-vehicle converter, the coil generates a large amount of heat. Accordingly, a powder compact and a resin-molded portion that are disposed near the coil thermally expand and contract due to heat cycles caused by the coil. Since the powder compact, which is mainly composed of a metal such as iron, and a resin have different coefficients of thermal expansion, there is a risk that the thermal expansion and contraction may cause the resin-molded portion to peel from the powder compact. If the resin-molded portion peels, for example, there is a possibility that insulation between the powder compact and the coil will become insufficient, and there is a possibility that the gap length provided between powder compacts will change. If such a problem occurs, the magnetic characteristics of the reactor are impaired. Moreover, if the resin-molded portion peels, and the plurality of powder compacts are not sufficiently integrated, there is a risk that the resonance frequency may change prior to and after peeling, and thus vibration and noise may increase compared with those prior to peeling.

The present invention was made in view of the above-described circumstances, and an object thereof is to provide a core component in which a powder compact and a resin-molded portion are strongly joined to each other. Another object of the present invention is to provide a method for manufacturing a core component in which the joinability to a resin-molded portion is excellent. Moreover, another object of the present invention is to provide a reactor that uses a core component in which the joinability to a resin-molded portion is excellent.

SUMMARY

A core component according to an aspect of the present invention is a core component including a powder compact that is obtained by compression molding a raw material powder containing a soft magnetic powder and a resin-molded portion that is formed on a surface of the powder compact, and constituting a part of a magnetic core to be disposed inside and outside a coil included in a reactor, wherein an intermediate layer formed of a silane coupling agent is provided between the powder compact and the resin-molded portion.

A method for manufacturing a core component according to an aspect of the present invention includes a step α of preparing a powder compact that is obtained by compression molding a raw material powder containing a soft magnetic powder, a step ß of treating a surface of the powder compact with a silane coupling agent, and a step γ of forming a resin-molded portion on the surface of the powder compact that has been treated with the silane coupling agent.

A reactor according to an aspect of the present invention is a reactor including a combined product having a coil and a magnetic core, wherein the magnetic core includes the core component according the aspect of the present invention.

Advantageous Effects of Invention

The above-described core component has excellent joinability between the powder compact and the resin-molded portion formed on the surface of the powder compact.

With the above-described method for manufacturing a core component, a core component in which the joinability to the resin-molded portion is excellent can be produced.

The above-described reactor uses a core component in which the joinability to the resin-molded portion is excellent.

DETAILED DESCRIPTION OF PREFERRED EMBODIMENTS

Figure 1:
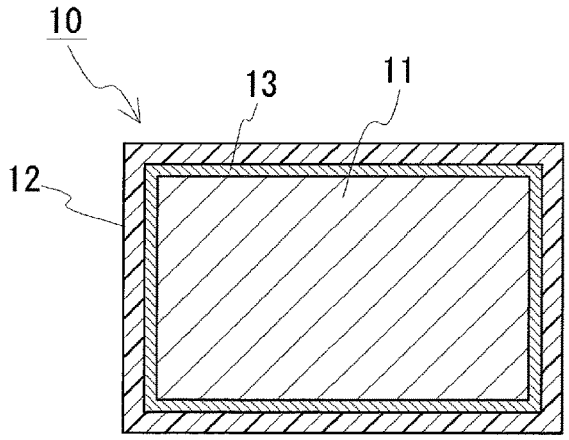
FIG. 1 is a schematic cross-sectional view of a core component described in Embodiment 1.

First, aspects of the present invention will be listed and described.

<1> A core component according to an embodiment is a core component including a powder compact that is obtained by compression molding a raw material powder containing a soft magnetic powder and a resin-molded portion that is formed on a surface of the powder compact, and constituting a part of a magnetic core to be disposed inside and outside a coil included in a reactor, wherein an intermediate layer formed of a silane coupling agent is provided between the powder compact and the resin-molded portion.

With the above-described core component, the powder compact and the resin-molded portion can be strongly joined to each other via the intermediate layer formed of the silane coupling agent. The silane coupling agent not only binds chemically to the surface of the powder compact but also binds chemically to the resin-molded portion, and therefore, the joining between the powder compact and the resin-molded portion via the intermediate layer is extremely strong.

<2> With respect to the core component of the embodiment, it is also possible that the resin-molded portion contains a binding aid that strengthens joining between the intermediate layer and the resin-molded portion, and the binding aid has at least one functional group selected from epoxy groups, carboxyl groups, acid anhydride groups, amino groups, and isocyanate groups.

When a resin forming the resin-molded portion contains a binding aid having a functional group capable of chemically binding to the silane coupling agent, the joining between the intermediate layer and the resin-molded portion can be strengthened. As a result, the joining between the powder compact and the resin-molded portion via the intermediate layer can be made even stronger. The binding aid contained in the resin remains in the resin-molded portion.

<3> A method for manufacturing a core component according to an embodiment includes a step α of preparing a powder compact that is obtained by compression molding a raw material powder containing a soft magnetic powder, a step ß of treating a surface of the powder compact with a silane coupling agent, and a step γ of forming a resin-molded portion on the surface of the powder compact that has been treated with the silane coupling agent.

With the above-described method for manufacturing a core component, it is possible to produce a core component of an embodiment in which an intermediate layer is formed between the powder compact and the resin-molded portion, the intermediate layer strongly joining the powder compact and the resin-molded portion to each other.

<4> A reactor according to an embodiment is a reactor including a combined product having a coil and a magnetic core, wherein the magnetic core includes the core component according to the embodiment.

In the above-described reactor, the powder compact and the resin-molded portion, of the core component are strongly joined to each other, and thus, problems such as peeling of the resin-molded portion from the powder compact are unlikely to occur. Accordingly, in the above-described reactor, problems due to peeling of the resin-molded portion are unlikely to occur.

Hereinafter, embodiments of a reactor of the present invention will be described based on the drawings. In the drawings, like reference numerals denote objects having like names. It should be understood that the present invention is not to be limited to configurations described in the embodiments, but rather is to be defined by the appended claims, and all changes that come within the meaning and range of equivalency of the claims are intended to be embraced therein.

Embodiment 1

Core Component

FIG. 1 is a schematic cross-sectional view of a core component 10 according to an embodiment. The core component 10 constitutes a part of a magnetic core to be disposed inside and outside a coil that is included in a reactor. The core component 10 includes a powder compact 11, which is a magnetic member, and a resin-molded portion 12 formed on the surface of the powder compact 11. Furthermore, the core component 10 includes an intermediate layer 13 that is formed between the powder compact 11 and the resin-molded portion 12.

Powder Compact

The powder compact 11 included in the core component 10 is obtained by compression molding a raw material powder containing a soft magnetic powder. The soft magnetic powder is an aggregate of magnetic particles composed of an iron-group metal, such as iron, an alloy thereof (a Fe—Si alloy, a Fe—Ni alloy, or the like), or the like. Preferably, the magnetic particles have an average particle diameter (D50) of, for example, between 1 μm and 1000 μm inclusive, and particularly between 10 μm and 500 μm inclusive. An insulating coating of between 10 nm and 1 μm inclusive composed of a phosphate or the like may also be formed on the surface of the magnetic particles. Moreover, in addition to the soft magnetic powder, the raw material powder may also contain a lubricant, such as stearamide, and a binder, such as a silicone resin. The lubricant and the binder may disappear during heat treatment of the powder compact, which will be described later.

The overall shape of the powder compact 11 may typically be, but not limited to, a rectangular parallelepiped shape shown in FIG. 1. Apart from the rectangular parallelepiped shape, the powder compact 11 may have a cylindrical shape, or may have a substantially semi-cylindrical shape such as that of an outer core portion shown in Embodiment 2, which will be described later.

Resin-Molded Portion

It is sufficient if the resin-molded portion 12 covers at least a portion of the outer periphery of the powder compact 11, but preferably, the resin-molded portion 12 covers the entire periphery of the powder compact 11. However, depending on the position where the core component 10 is disposed in the magnetic core, a configuration may also be adopted in which a portion of the outer periphery of the powder compact 11 is not covered with the resin-molded portion 12 on purpose. For example, a second core component 320 (see FIG. 5) of Embodiment 2, which will be described later, is an example of a configuration in which a portion of an outer core portion 32 (powder compact) is exposed from a resin-molded portion 320*m*.

Unlike the configuration shown in FIG. 1, a configuration can also be adopted in which a plurality of powder compacts 11 are integrated into a single member by using the resin-molded portion 12. For example, a first core component 310 (see FIG. 5) of Embodiment 2, which will be described later, is an example of a configuration in which a plurality of split cores 31*m* (powder compacts) are covered with a resin-molded portion 310*m*.

With regard to the resin composing the resin-molded portion 12, for example, thermoplastic resins such as polyphenylene sulfide (PPS) resins, polytetrafluoroethylene (PTFE) resins, liquid crystal polymers (LCPs), polyamide (PA) resins such as nylon 6 and nylon 66, polybutylene terephthalate (PBT) resins, and acrylonitrile-butadiene-styrene (ABS) resins can be used. In addition, thermosetting resins such as unsaturated polyester resins, epoxy resins, urethane resins, and silicone resins can also be used. Moreover, it is also possible to improve heat dissipation properties of the resin-molded portion 12 by mixing a ceramic filler such as alumina, silica, or the like in these resins.

The resin-molded portion 12 may further contain a binding aid that strengthens the joining between the intermediate layer 13, which will be described later, and the resin-molded portion 12. The binding aid will be described again in the section of the intermediate layer 13 below.

Intermediate Layer

The intermediate layer 13 included in the core component 10 is disposed between the surface of the powder compact 11 and the resin-molded portion 12 and strongly joins the powder compact 11 and the resin-molded portion 12 to each other. The intermediate layer 13 is formed of a silane coupling agent, and not only binds chemically to the surface of the powder compact 11 but also binds chemically to the resin-molded portion 12.

Figure 2:
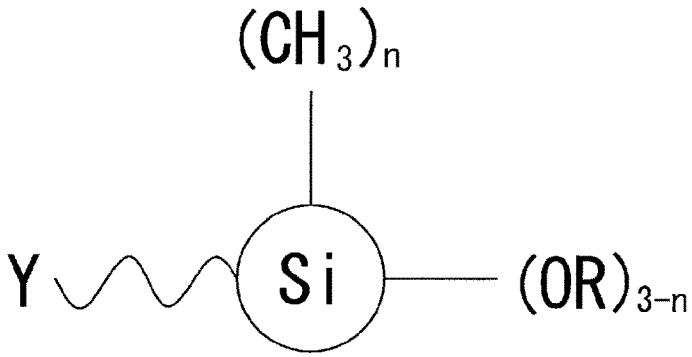
FIG. 2 schematically shows the chemical structure of a silane coupling agent.

FIG. 2 shows an example of the basic structure of the silane coupling agent. OR in the diagram is a hydrolyzable group ($OCH_3$, $OC_2H_5$, $OCOCH_3$, or the like), and Y also in the diagram is a reactive functional group (amino group, epoxy group, methacrylic group, vinyl group, mercapto group, or the like). The hydrolyzable group binds chemically to the surface of the powder compact 11 through hydrogen bonding with a hydroxyl group on the surface of the powder compact 11 and a dehydration condensation polymerization reaction. Meanwhile, the reactive functional group binds chemically to a functional group of the resin-molded portion 12. Consequently, the powder compact 11 and the resin-molded portion 12 are strongly joined to each other by the intermediate layer 13, which is formed of the silane coupling agent.

Here, the joining between the intermediate layer 13 and the resin-molded portion 12 can be further strengthened if the resin-molded portion 12 contains a binding aid including a functional group that can easily bind chemically to the reactive functional group of the silane coupling agent, which forms the intermediate layer 13. Examples of the functional group that can easily bind chemically to the reactive functional group of the silane coupling agent include epoxy groups, carboxyl groups, acid anhydride groups, amino groups, isocyanate groups, and the like. This means that it is preferable to use a binding aid having at least one of the above-described functional groups as the binding aid.

Examples of the binding aid include a maleic anhydride-modified ethylene-based copolymer, a glycidyl methacrylate-modified ethylene-based copolymer, a glycidyl ether-modified ethylene copolymer, an epoxy resin, an isocyanate compound, and the like.

Method for Manufacturing Core Component

A method for manufacturing the above-described core component 10 includes a step α of preparing a powder compact 11 that is obtained by compression molding a raw material powder containing a soft magnetic powder, a step ß of treating the surface of the powder compact 11 with a silane coupling agent, and a step γ of forming the resin-molded portion 12 on the surface of the powder compact 11 that has been treated with the silane coupling agent.

Step α

The powder compact 11 can be obtained by using a known method for manufacturing a powder compact. That is to say, the powder compact 11 can be obtained by filling a raw material powder containing a soft magnetic powder into a cavity of a mold and compression molding the raw material powder. The raw material powder that has already been described in the section of the powder compact 11 above can be used as the raw material powder. The pressure of compression molding of the raw material powder can be set between 390 MPa and 1500 MPa inclusive.

Preferably, the powder compact 11 after compression molding is subjected to predetermined heat treatment. The reason for this is that, during compression molding, strain is introduced into the magnetic particles contained in the raw material powder. This strain may increase the hysteresis loss of the powder compact 11 but can be removed through heat treatment. The heat treatment can be performed under the following conditions: between 400° C. and 700° C. inclusive, and between 30 minutes and 60 minutes inclusive.

Step ß

To treat the surface of the powder compact 11 with the silane coupling agent, for example, a treatment solution containing the silane coupling agent can be applied to the surface of the powder compact 11, or the powder compact 11 can be immersed in the treatment solution. The solvent in which the silane coupling agent is dissolved may be water or may be a water-soluble organic solvent, such as ethanol or acetone, or the like.

The concentration of the silane coupling agent in the solution can be selected as appropriate. For example, the content of the silane coupling agent in the treatment solution can be set between 0.05 mass % and 2.0 mass % inclusive, or between 0.1 mass % and 1.5 mass % inclusive. If the content of the silane coupling agent is less than 0.05 mass %, the intermediate layer 13 cannot be sufficiently formed. Moreover, if the content of the silane coupling agent is more than 2.0 mass %, the silane coupling agent layer is formed as a multilayer, and thus, there is a risk that peeling may occur between the silane coupling agent layers.

Prior to treating the surface of the powder compact 11 with the silane coupling agent, it is preferable to pre-treat the surface of the powder compact 11 with an alkaline solution or an acidic solution. The pre-treatment is performed in order to generate a functional group (hydroxyl group) that is beneficial in the reaction with the silane coupling agent on the surface of the powder compact 11. An aqueous solution of sodium hydroxide, potassium hydroxide, sodium carbonate, or the like can be used as the alkaline solution. Also, a solution of hydrochloric acid, nitric acid, phosphoric acid, or sulfuric acid, or the like can be used as the acidic solution.

Step γ

Figure 3:
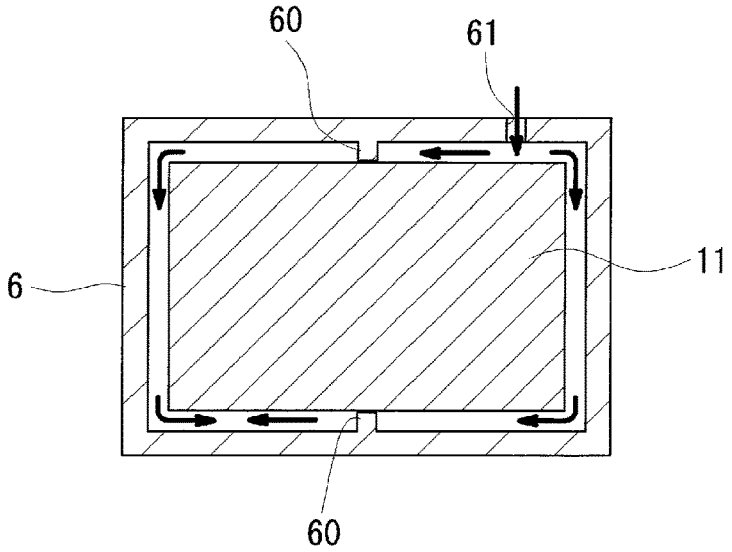
FIG. 3 is a schematic diagram for explaining a method for forming a resin-molded portion.

To form the resin-molded portion 12 on the surface of the powder compact 11, for example, a mold 6 for molding shown in FIG. 3 can be used. The mold 6 for molding includes retaining members 60 for retaining the powder compact 11 spaced apart from an inner peripheral surface of the mold 6 for molding, and an injection port 61 through which a resin is injected into the inside of the mold 6 for molding. When the resin is filled through the injection port 61, the resin spreads throughout the mold 6 for molding along the outer periphery of the powder compact 11 as indicated by the thick arrows in the diagram, and thus, the resin-molded portion 12 shown in FIG. 1 can be formed. At this time, the intermediate layer 13 derived from the silane coupling agent is formed between the powder compact 11 and the resin-molded portion 12.

Here, as already described above, it is preferable that the resin composing the resin-molded portion 12 contains the binding aid. Due to the resin containing the binding aid, the joining between the intermediate layer 13 and the resin-molded portion 12 can be strengthened when the resin has cured. The optimal content of the binding aid in the resin varies depending on the type of the resin, the type of the binding aid, and the type of the silane coupling agent, and therefore cannot be determined in a generalized manner. For example, when the total mass of the resin and the binding aid is taken as 100, the content of the binding agent in the resin may be set between 1 mass % and 50 mass % inclusive, or between 2 mass % and 25 mass % inclusive.

Test Examples

A plurality of powder compacts 11 were provided, and specimens 1 to 7 (core components 10) were produced in which resin-molded portions 12 were formed on the surface of the respective powder compacts 11. The powder compacts 11 used for the respective specimens 1 to 7 had the same configuration. The following materials were used to form the resin-molded portions 12 of the specimens 1 to 7. Table 1 shows the compositions of the respective specimens 1 to 7.

Resin composing the resin-molded portion 12

A PPS resin or a PA9T resin (polyamide resin manufactured by Kuraray Co., Ltd.)

Binding aid

A glycidyl methacrylate-modified ethylene-based copolymer (hereinafter referred to as "compound I") or a maleic anhydride-modified ethylene-based copolymer (hereinafter referred to as "compound II")

Coupling agent

A silane coupling agent (hereinafter referred to as "amino-based coupling agent") having an amino group as the reactive functional group or a silane coupling agent (hereinafter referred to as "epoxy-based coupling agent") having an epoxy group as the reactive functional group The produced specimens 1 to 7 were subjected to a peel test (JIS K 6850) with respect to the resin-molded portion 12. According to the results of the peel test, the specimens were evaluated as A, B, or C in decreasing order of joining strength between the powder compact 11 and the resin-molded portion 12. The specimens evaluated as A were those in which the powder compact 11 was broken or the surface of the powder compact 11 peeled off when the resin-molded portion 12 was peeled off, and the specimens evaluated as C were those in which no specific damage to the powder compact 11 occurred. Moreover, the specimens evaluated as B were those in which, although the powder compact 11 was not as damaged as were those of the specimens evaluated as A, the resin-molded portion 12 was hard to peel off. Table 1 also shows the results of the peel test.

TABLE 1

| No | Resin-molded portion | Coupling aid | Coupling agent | Joinability |
|---|---|---|---|---|
| 1 | PPS | Compound I | Amino-based | A |
| 2 | PPS | Compound II | Epoxy-based | A |
| 3 | PA9T | Compound II | Epoxy-based | A |
| 4 | PPS | Compound I | None | C |
| 5 | PPS | None | Amino-based | B |
| 6 | PA9T | Compound II | None | C |
| 7 | PA9T | None | Epoxy-based | B |

As shown in Table 1, the joinability of the specimens 1 to 3, in which the resin-molded portion 12 contained a binding aid, and the surface of the powder compact 11 was treated with a silane coupling agent, were evaluated as A. The joinability of the specimens 5 and 7, in which, although the resin-molded portion 12 contained no binding aid, the surface of the powder compact 11 was treated with a silane coupling agent, were evaluated as B. On the other hand, the joinability of the specimens 4 and 6, in which, although the resin-molded portion 12 contained a binding aid, the surface of the powder compact 11 was not treated with a silane coupling agent, were evaluated as C. These results made it clear that treating the surface of the powder compact 11 with a silane coupling agent improves the joinability between the powder compact 11 and the resin-molded portion 12. It also was made clear that the joinability between the powder compact 11 and the resin-molded portion 12 further improve if, in addition to the surface treatment of the powder compact 11 with a silane coupling agent, the resin-molded portion 12 contains a binding aid.

Embodiment 2

In Embodiment 2, an example of a reactor 1 using the core component 10 described in Embodiment 1 will be described with reference to FIGS. 4 and 5.

Overall Configuration

Figure 4:
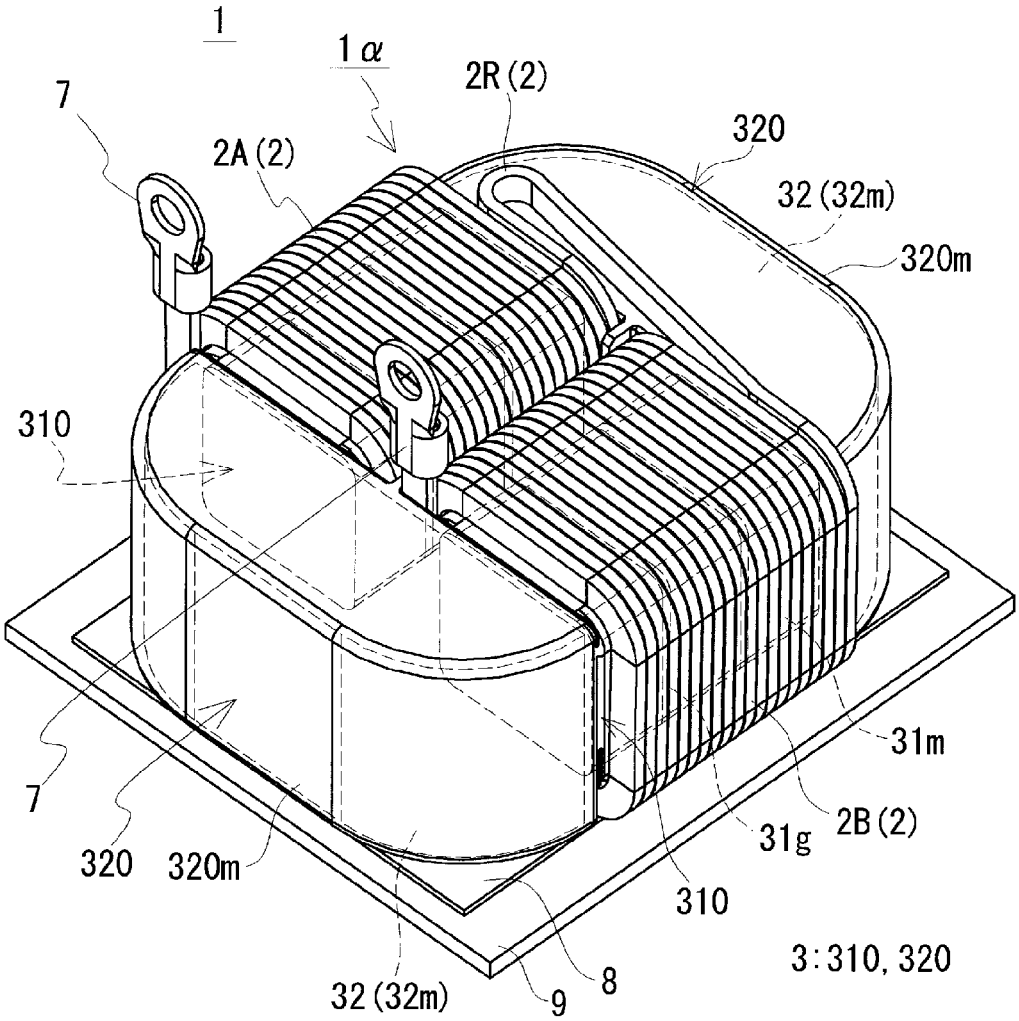
FIG. 4 is a schematic perspective view of a reactor of Embodiment 2 when viewed from above.
Figure 5:
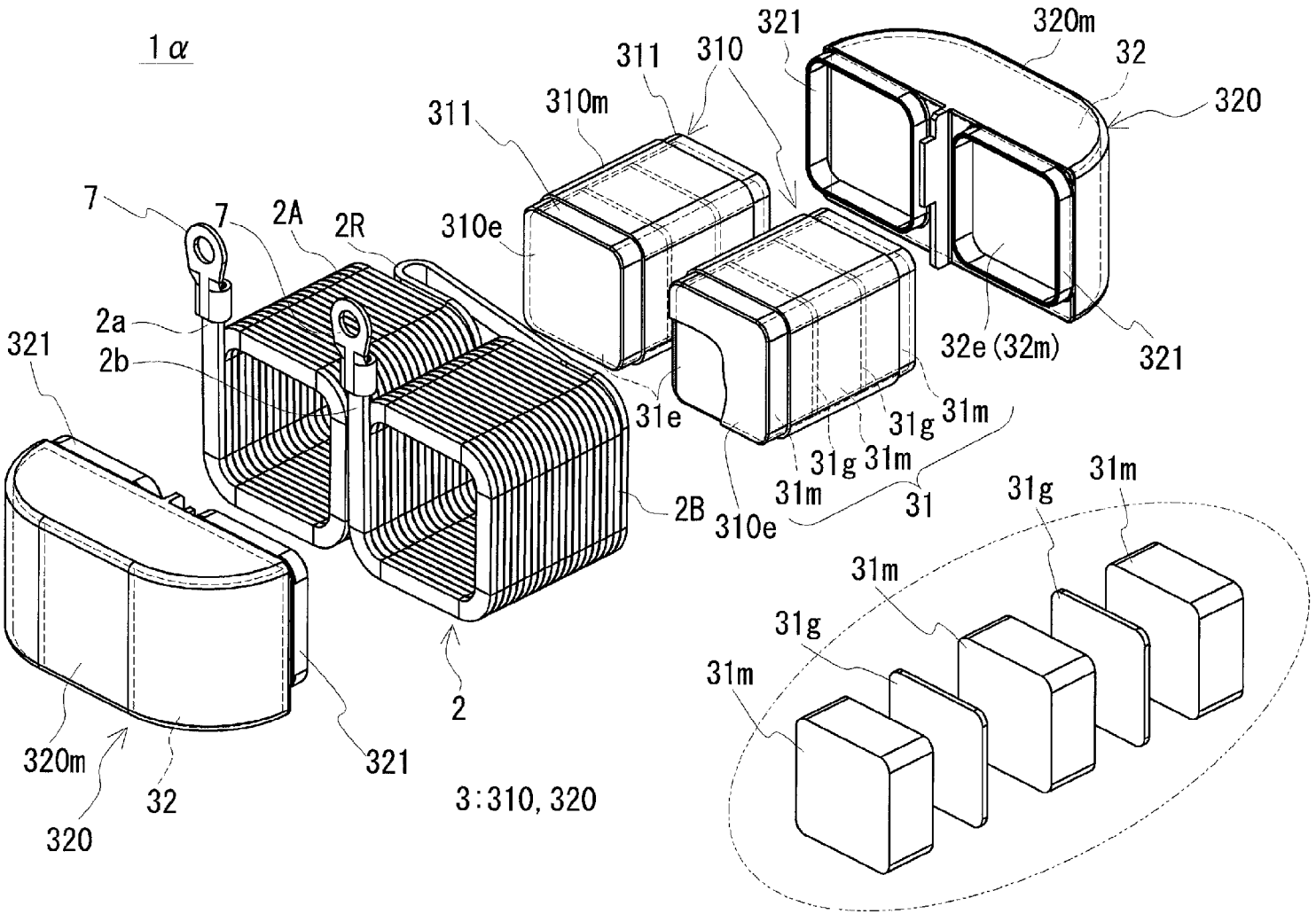
FIG. 5 is an exploded perspective view of a combined product included in the reactor of Embodiment 2.

The reactor 1 shown in FIG. 4 has a configuration in which a combined product 1*a* having the coil 2 and the magnetic core 3 is fixed onto a mount plate 9 via a coupling layer 8. In the reactor 1 of the present example, the configuration of the core component 10 of Embodiment 1 is applied to the first core components 310 and the second core components 320 constituting the magnetic core 3, which will be described later.

Combined Product

The combined product 1*a* in which the coil 2 and the magnetic core 3 are mechanically combined will be described with reference mainly to the exploded perspective view of FIG. 5.

Coil

The coil 2 of the present embodiment includes a pair of winding portions 2A and 2B and a connecting portion 2R that connects the two winding portions 2A and 2B to each other. The winding portions 2A and 2B are formed into hollow tube shapes having the same number of turns and the same winding direction and are arranged side-by-side such that their axial directions are parallel to each other. The connecting portion 2R is a portion that connects the two winding portions 2A and 2B to each other and that is bent into a U-shape. The coil 2 may be formed by helically winding a single wire having no joint portion, or may be formed by producing the winding portions 2A and 2B using separate wires and joining wire end portions of the respective winding portions 2A and 2B to each other through welding, crimping, or the like.

Each of the winding portions 2A and 2B of the present embodiment is formed into a rectangular tube shape. The winding portions 2A and 2B having a rectangular tube shape refer to winding portions whose end surfaces have a quadrangular shape (including a square shape) with rounded corners. It goes without saying that the winding portions 2A and 2B can also be formed into a cylindrical tube shape. A cylindrical tube-shaped winding portion refers to a winding portion whose end surfaces have a closed curve shape (elliptical shape, perfect circle shape, racetrack shape, or the like).

The coil 2 including the winding portions 2A and 2B can be constituted by a coated wire including a conductor, such as a rectangular wire, a round wire, or the like, made of a conductive material, such as copper, aluminum, magnesium, or an alloy thereof, and an insulating coating made of an insulating material and provided on an outer circumference of the conductor. In the present embodiment, each winding portion 2A, 2B is formed by winding a coated rectangular wire edgewise, the coated rectangular wire being constituted by a rectangular wire made of copper, which serves as the conductor, and the insulating coating made of enamel (typically, polyamideimide).

Both end portions 2*a* and 2*b* of the coil 2 are drawn out from the winding portions 2A and 2B and connected to respective terminal members 7. An external device such as a power supply that supplies power to the coil 2 is connected via the terminal members 7.

Magnetic Core

The magnetic core 3 of the present example includes a pair of first core components 310 that are formed into a column shape and a pair of second core components 320 that connect end surfaces 310*e* of the first core components 310. The first core components 310 and the second core components 320 are connected together in a ring shape, thereby forming the magnetic core 3.

First Core Component

The first core components 310 are members each including an inner core portion 31 that is disposed inside the winding portion 2A (2B) of the coil 2 and a resin-molded portion 310*m* that covers the outer periphery of the inner core portion 31. The inner core portion 31 is constituted by a plurality of split core pieces 31*m* and a plurality of gap materials 31*g* that are alternately stacked one on top of another (see also an exploded perspective view of the inner core portion 31 within the dashed and double-dotted line at the lower right). The split core pieces 31*m* are powder compacts that are each obtained by compression molding a raw material powder containing a soft magnetic powder. That is to say, each of the first core components 310 is a core component into which a plurality of powder compacts (split core pieces) are integrated by using the resin-molded portion 310*m*, and adopts the same configuration as the core component 10 of Embodiment 1. The gap materials 31*g* are members for adjusting the magnetic characteristics of the inner core portion 31, and can be composed of alumina or the like, for example.

To produce the above-described first core component 310, the inner core portion 31 in which the split core pieces 31*m* and the gap materials 31*g* are stacked one on top of another is immersed in a treatment solution containing a silane coupling agent, and then the resin-molded portion 310*m* can be formed on the surface of the inner core portion 31. As a result, the intermediate layer 13 (see FIG. 1) is formed between the resin-molded portion 310*m* and the split cores 31*m* (powder compacts) of the inner core portion 31, so that peeling of the resin-molded portion 310*m* from the inner core portion 31 can be suppressed.

Figure 6:
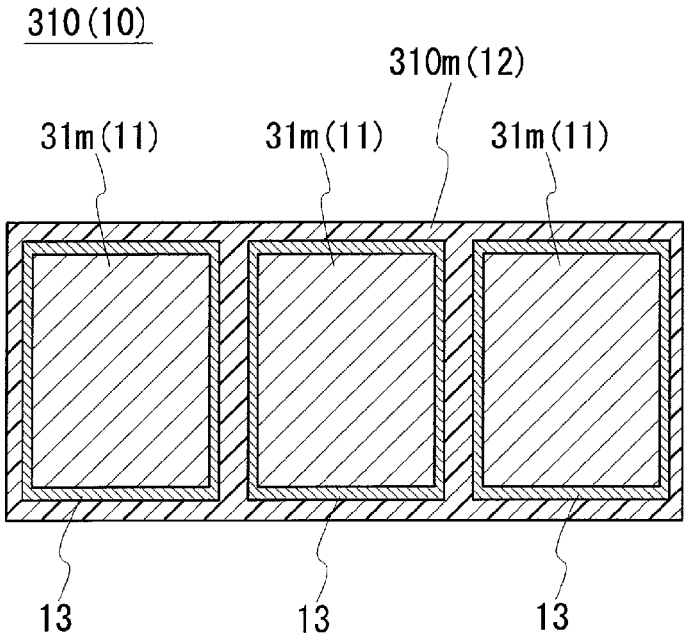
FIG. 6 is a schematic vertical cross-sectional view of a first core component having a configuration different from that of a first core component shown in FIG. 5.

Here, the first core component 310 can also have a form shown in the vertical cross-sectional view of FIG. 6. The first core component 310 (core component 10) shown in FIG. 6 has a configuration in which three split core pieces 31*m* (powder compacts 11) are lined up spaced apart from each other, and integrated together by using the resin-molded portion 310*m* (12). In this case, the resin-molded portion 310*m* penetrating between two adjacent core pieces 31*m* functions as a gap material. This configuration eliminates the time and effort involved in separately preparing a gap material, and can improve the productivity of the first core component 310. Moreover, since the intermediate layer 13 is formed around the entire periphery of each split core piece 31*m*, peeling of the resin-molded portion 310*m* can be effectively suppressed.

Second Core Component

The second core components 320 are members in each of which the outer periphery of the corresponding outer core portion 32, which is disposed outside the winding portions 2A and 2B, is covered with a resin-molded portion 320*m*. The outer core portions 32 are each constituted by a substantially semi-cylindrical shaped split core piece 32*m*, which is a powder compact. The same configuration as that of the core component 10 of Embodiment 1 is applied to each second core component 320.

To produce the above-described second core component 320, the split core piece 32*m* is immersed in a treatment solution containing a silane coupling agent, and then the resin-molded portion 320*m* can be formed on the surface of the split core piece 32*m*. As a result, the intermediate layer 13 (see FIG. 1) is formed between the split core piece 32*m* (powder compact) and the resin-molded portion 320*m*, so that peeling of the resin-molded portion 320*m* from the split core piece 32*m* (outer core portion 32) can be suppressed.

Other Configurations Regarding Core Component

The first core components 310 and the second core components 320 of the present example are connected together through mechanical fitting of thin portions 311 that are formed at axial end portions of the first core components 310 to frame portions 321 that are formed in the second core components 320. The thin portions 311 are formed by reducing the thickness of the resin-molded portions 310*m* compared with that in the other portions, and the frame portions 321 are formed by making the resin-molded portions 320*m* protrude. Inside the frame portions 321, the outer core portions 32 are exposed without being covered by the resin-molded portions 320*m*.

In the configuration of the present example in which the first core components 310 and the second core components 320 are connected together, end surfaces 310*e* of the first core components 310 come into contact with end surfaces 32*e* of the outer core portions 32 (split core pieces 32*m*) of the second core components 320. An adhesive may also be used between the end surfaces 310*e* and the end surfaces 32*e*. Here, the end surfaces 310*e* are composed of the resin-molded portions 310*m* that cover end surfaces 31*e* of the inner core portions 31. Therefore, in the present example, the resin-molded portions 310*m* function as gap materials between the end surfaces 31*e* of the inner core portions 31 and the end surfaces 32*e* of the outer core portion 32.

Other Configurations

The reactor 1 of Embodiment 1 includes the mount plate 9, the coupling layer 8, and the like as shown in FIG. 4.

Mount Plate

The mount plate 9 is a member that functions as a base when the reactor 1 is fixed to an installation target such as a cooling base. For this purpose, the mount plate 9 is required to have excellent mechanical strength. Moreover, the mount plate 9 is required to serve to release heat generated in the combined product 1*a* during use of the reactor 1 to the installation target. For this purpose, the mount plate 9 is required to have excellent heat dissipation properties in addition to mechanical strength. To meet these requirements, the mount plate 9 is composed of a metal. For example, aluminum and its alloys and magnesium and its alloys can be used as the material composing the mount plate 9. These metals (alloys) have advantages of being excellent in mechanical strength and thermal conductivity, lightweight, and non-magnetic.

Coupling Layer

The coupling layer 8 is formed between the above-described mount plate 9 and the combined product 1*a*, the coupling layer 8 joining the combined product 1*a* and the mount plate 9 to each other. The coupling layer 8 also has the function of conducting heat generated in the combined product 1*a* during use of the reactor 1 to the mount plate 9.

A material having insulating properties is used as the material composing the coupling layer 8. Examples thereof include thermosetting resins such as epoxy resins, silicone resins, and unsaturated polyesters and thermoplastic resins such as PPS resins and LCPs. The heat dissipation properties of the coupling layer 8 may be improved by these insulating resins containing the above-described ceramic filler and the like. The coupling layer 8 preferably has a thermal conductivity of, for example, 0.1 w/m K or more, more preferably 1 w/m K or more, and particularly preferably 2 w/m K or more.

The coupling layer 8 may be formed by applying an insulating resin, which may be a resin containing a ceramic filler, or may be formed by bonding a sheet material made of an insulating resin onto the mount plate 9. The use of a sheet-like material as the coupling layer 8 is preferable because this makes it easy to form the coupling layer 8 on the mount plate 9.

Effects of Reactor

In the reactor 1 that is configured as described above, the resin-molded portions 310*m* and 320*m* of the magnetic core 3 are unlikely to peel off even when thermal expansion and contraction of the magnetic core 3 occur due to use of the reactor 1. Accordingly, problems due to peeling of the resin-molded portions 310*m* and 320*m*, such as a deterioration of the magnetic characteristics of the reactor 1, vibration and noise, and other problems, are unlikely to occur.

The reactor according to Embodiment 2 can be preferably applied to uses where the energization conditions are, for example, maximum current (direct current): about 100 A to 1000 A, average voltage: about 100 V to 1000 V, and working frequency: about 5 kHz to 100 kHz, and typically for a constituent component of an in-vehicle power conversion device installed in an electric automobile, a hybrid automobile, or the like. For these uses, it is expected that a reactor that satisfies the requirements that the inductance when the flowing direct current is 0 A is between 10 pH and 2 mH inclusive, and the inductance when the maximum current flows is 10% or more of the inductance at 0 A can be preferably used.

INDUSTRIAL APPLICABILITY

A core component of the present invention can be used in a reactor included in a power conversion device, such as a bidirectional DC-DC converter, installed in electric vehicles such as hybrid automobiles, electric automobiles, and fuel-cell electric automobiles.

The invention claimed is:

1. A core component comprising:

a powder compact that is obtained by compression molding a raw material powder containing a soft magnetic powder;

a resin-molded portion that bounds an outer surface of the powder compact, and constituting a part of a magnetic core to be disposed inside and outside a coil included in a reactor, wherein the soft magnetic powder is an aggregate of magnetic particles having an insulating coating, and an intermediate layer formed of a silane coupling agent bounds an outer surface of the powder compact so as to be disposed between the powder compact and the resin-molded portion and separate the powder compact from the resin-mold portion.

2. The core component according to claim 1, wherein the resin-molded portion contains a binding aid that further binds the intermediate layer to the resin-molded portion, and the binding aid has at least one functional group selected from the group consisting of: epoxy groups, carboxyl groups, acid anhydride groups, amino groups, and isocyanate groups.

3. A reactor comprising a combined product having a coil and a magnetic core, wherein the magnetic core includes the core component according to claim 1.

4. A method for manufacturing a core component, the method comprising:

a step α of preparing a powder compact that is obtained by compression molding a raw material powder containing a soft magnetic powder;

a step β of treating a surface of the powder compact with a silane coupling agent; and a step γ of forming a resin-molded portion on the surface of the powder compact that has been treated with the silane coupling agent.

* * * * *